US007413187B2

(12) United States Patent
Mitsuhashi

(10) Patent No.: US 7,413,187 B2
(45) Date of Patent: Aug. 19, 2008

(54) PRINTER

(75) Inventor: Masaaki Mitsuhashi, Daito (JP)

(73) Assignee: Funai Electric Co., Ltd., Daito -shi (JP)

( * ) Notice: Subject to any disclaimer, the term of this patent is extended or adjusted under 35 U.S.C. 154(b) by 322 days.

(21) Appl. No.: 11/169,945

(22) Filed: Jun. 30, 2005

(65) Prior Publication Data

US 2006/0012106 A1 Jan. 19, 2006

(30) Foreign Application Priority Data

Jul. 2, 2004 (JP) ..... 2004-197270

(51) Int. Cl.
*B65H 1/00* (2006.01)

(52) U.S. Cl. ..... 271/162; 271/160; 271/145

(58) Field of Classification Search ..... 271/162, 271/160, 127, 145
See application file for complete search history.

(56) References Cited

U.S. PATENT DOCUMENTS 7,080,033 B2 * 7/2006 Wilton et al. ..... 705/35
2005/0225025 A1 * 10/2005 Chikumoto ..... 271/162

FOREIGN PATENT DOCUMENTS

JP 06032467 A * 2/1994
JP 09-315606 A 12/1997
JP 2002-096945 A 4/2002

* cited by examiner

*Primary Examiner*—Kaitlin S Joerger
(74) *Attorney, Agent, or Firm*—Crowell & Moring LLP

(57) ABSTRACT

A printer has a paper rest on which one or more paper sheet is placed, feed rollers for feeding the paper sheet placed on the paper rest, and a printing head for printing an image on the paper sheet. The paper rest has a fixed rest portion, the inclination of which is fixed and a movable rest portion rotatably supported on the fixed rest portion and a torsion spring is interposed between the fixed rest portion and the movable rest portion for generating elastic force according to rotation of the movable rest portion. Due to self-weight of the paper sheets placed on the paper rest and the elastic force of the torsion spring, the movable rest portion is inclined more steep when the number of the paper sheets placed on the paper rest smaller and is inclined more gentle when the number of the paper sheets is larger.

5 Claims, 3 Drawing Sheets

PRINTER

BACKGROUND OF THE INVENTION

1. Field of the Invention

The present invention relates to a printer that feeds a paper sheet placed on a paper rest and prints an image on the paper sheet.

2. Description of the Related Art

Conventionally, there is a printer that has a paper rest on which paper sheets are placed, and feeds a paper sheet from the paper rest to a printing head portion to print an image on the paper sheet. In such a printer, a plurality of laminated paper sheets can be placed on the paper rest and the paper sheets are fed one by one by using a paper sheet feeding mechanism. A plane of the paper rest on which the paper sheets are placed is inclined obliquely in a direction of feeding of the paper sheet and fixed at a certain angle.

Furthermore, a conventional paper sheet feeder, for example, shown in Japanese Laid-Open Patent Publication No. 9-315606, is configured so that an angle of a division plate for dividing a paper sheet from the rest due to frictional force with respect to the lamination of the paper sheets can be adjusted, or a gap between the division plate and a feed roller for feeding the divided paper sheet can be adjusted. Thus, it is possible the paper sheets can be fed with no failure of feeding of the paper sheet while dividing the paper sheets one by one.

Still furthermore, another conventional paper sheet feeder, for example, shown in Japanese Laid-Open Patent Publication No. 2002-96945, is configured so that an angle of an auxiliary tray for supporting and guiding a rear end of paper sheets can be adjusted by operation of an operation lever. Thus, it is possible to control variation of an angle of a front end of the paper sheets with respect to a division pad, thereby to achieve stable sheet feeding.

SUMMARY OF THE INVENTION

In the above-mentioned conventional printers, however, the inclination of the plane of the paper rest on which the paper sheets are placed is fixed. When a paper sheet placement plane of the paper rest is too vertically oriented, and when a large number of paper sheets is placed on the paper rest, a load of feeding of the paper sheet becomes too large to feed the paper sheet due to solidity of the paper sheets. Alternatively, when the paper sheet placement plane is too horizontally oriented, and when a small number of paper sheets is placed, multi-feeding of the paper sheets occurs. Even when contents disclosed in the above conventional paper feeders are applied, the above-mentioned problems cannot be solved.

A purpose of the present invention is to provide a printer capable of preventing failure of feeding of the paper sheer with no relation to the number of paper sheets placed on the paper rest by varying the angle of the paper rest depending on self-weight of the paper sheets.

A printer in accordance with an aspect of the present invention comprises: a paper rest having a paper sheet placement plane on which at one or more paper sheet is placed; a paper sheet feeding mechanism for feeding a paper sheet placed on the paper rest; and a printing head for printing an image on the paper sheet fed by the paper sheet feeding mechanism.

The paper rest further has: a fixed rest portion that is located at downstream side in a direction of feeding of the paper sheet and fixed so that inclination of a paper sheet replacement plane thereof is fixed, on which a portion of the paper sheet is placed; a movable rest portion that is located at upstream side in the direction of feeding of the paper sheet and rotatably supported on the fixed rest portion so that inclination of a paper sheet replacement plane thereof can be varied, on which remaining portion of the paper sheet is placed; and an elastic member interposed between the fixed rest portion and the movable rest portion for generating elastic force according to rotation of the movable rest portion.

The movable rest portion, a position of which is held by elastic force of the elastic member, is rotated by self-weight of the paper sheet or paper sheets placed on the paper rest.

By such a configuration, the paper sheet placement plane of the movable rest portion is inclined more gentle, when the number of the paper sheets placed on the paper rest is larger. Thus, when the number of the paper sheets placed on the paper rest is large, failure of feeding of the paper sheet due to increase of a load for feeding paper sheet caused by, for example, elasticity of the paper sheet rarely occurs. Furthermore, the paper sheet placement plane of the movable rest portion is inclined more steep when the number of the paper sheets placed on the paper rest is smaller. Thus, when the number of the paper sheets placed on the paper rest is small, failure of feeding of the paper sheet such as multi-feeding of the paper sheets can be prevented.

Furthermore, it is possible that when no paper sheet is placed on the paper rest, the movable rest portion is held at an initial position where an angle that the paper sheet placement plane of the movable rest portion forms with the paper sheet placement plane of the fixed portion is less than 180 degrees due to elastic force of the elastic member.

Still furthermore, it is possible that rotation of the movable rest portion backward is restricted when a lower end of the movable rest portion contacts with an upper end of the fixed rest portion, and the angle that the paper sheet placement plane of the movable rest portion forms with the paper sheet placement plane of the fixed portion becomes substantially 180 degrees.

DETAILED DESCRIPTION OF THE EMBODIMENT

A printer in accordance with an embodiment of the present invention will be described below with reference to figures.

Figure 1:
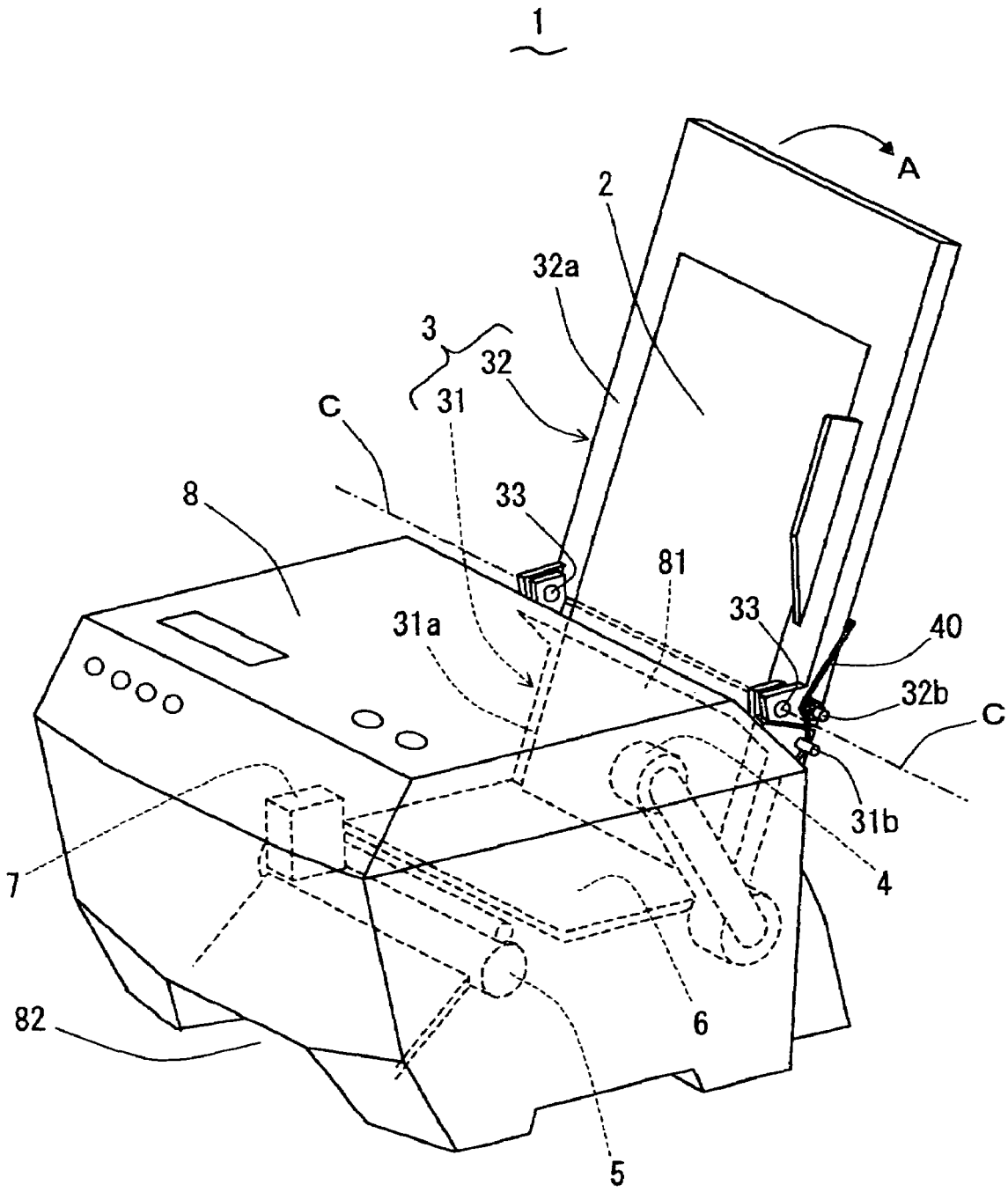
FIG. 1 is a perspective view showing a configuration of a printer in accordance with an embodiment of the present invention.
Figure 2:
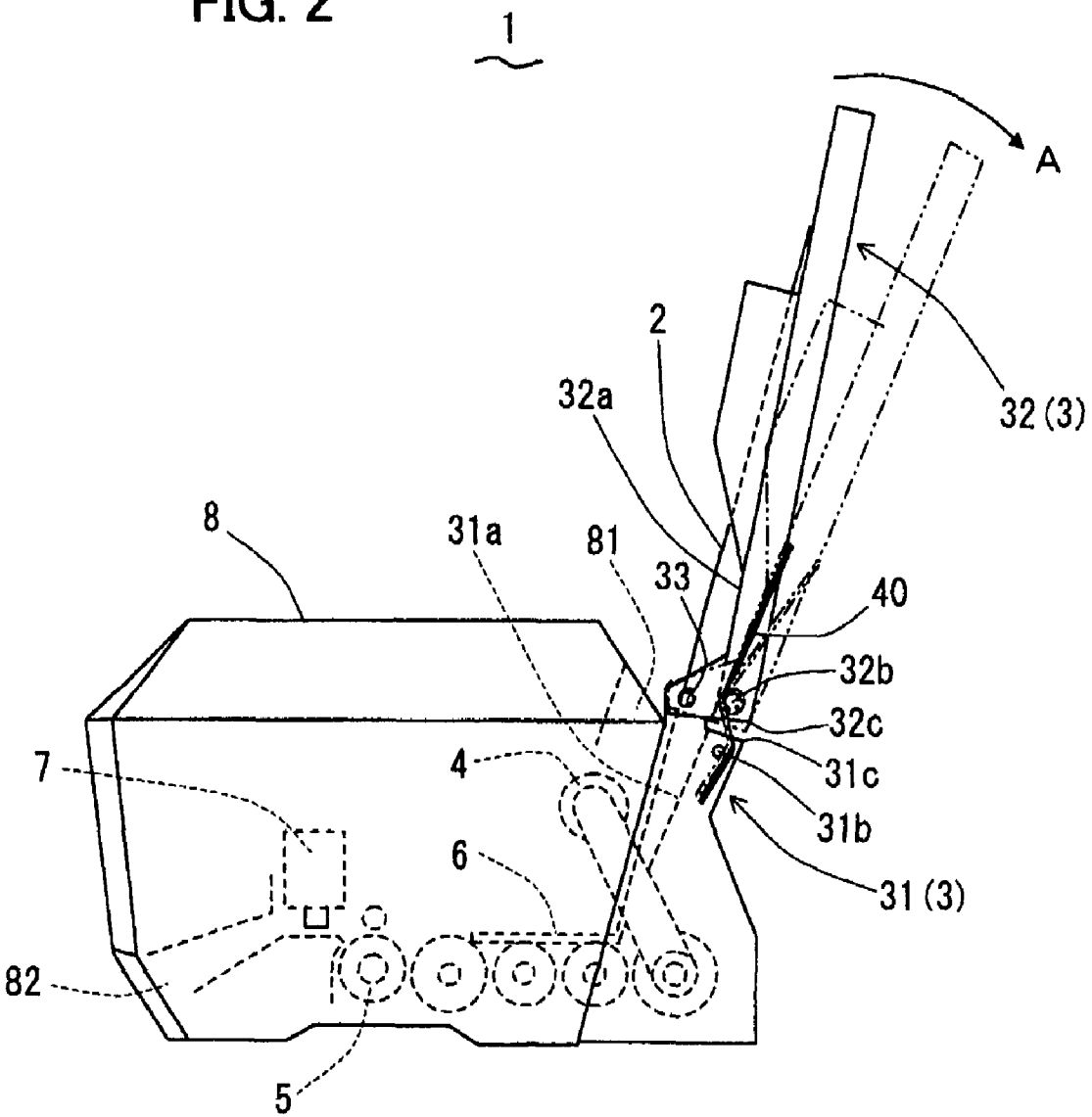
FIG. 2 is a side view of the printer.

A configuration of the printer is shown in FIGS. 1 and 2. The printer 1 is used for printing an image on a paper sheet 2 on the basis of an image data input from a digital camera, a personal computer, or the like. The printer 1 has a paper rest 3 on which the paper sheets 2 are placed, feed rollers 4 and 5 serving as a paper feeding mechanism for feeding the paper sheet 2, a division pad 6 for dividing the paper sheets one by one, a printing head 7 for printing an image on the paper sheet 2, and a housing 8 that contains the feed rollers 4 and 5, division pad 6 and printing head 7 therein. The housing 8 is provided with a paper sheet inlet 81 from which the paper sheet 2 is fed and a paper sheet outlet 82 from which the paper sheet 2 on which an image is printed is emitted.

The paper rest 3 has a fixed rest portion 31 located at downstream side in a direction of feeding of the paper sheet 2, and a movable rest portion 32 located at upstream side in the direction of feeding of the paper sheet 2. An angle of the fixed rest portion 31 with respect to the paper feeding mechanism is fixed, and an angle of the movable rest portion 32 with respect to the fixed rest portion 31 is variable. Details of the paper rest 3 will be described later.

As for the paper sheet 2, various kinds and sizes such as A4 size and letter size of cut paper sheets can be used, and one or more paper sheets is placed on the paper rest 3. A part of the paper sheet 2 is placed on the fixed rest portion 31 and remaining part of the paper sheet 2 is placed on the movable rest portion 32. That is, the paper sheet 2 is placed over both of the fixed rest portion 31 and the movable rest portion 32. A part of the paper sheet 2 placed on the paper rest 3 is inserted into the paper sheet inlet 81 of the housing 8 and the front end of the paper sheet 2 comes into contact with the division pad 6 and is held by the pad 6.

The feed roller 4 feeds the paper sheet 2 placed on the paper rest 3 to the feed roller 5. The paper sheets 2 placed on the paper rest 3 are divided one by one due to frictional force of the division pad 6 and fed to the feed roller 5. When the paper sheet 2 is fed, the feed roller 4 is contacted to the paper sheet 2 with a pressure and driven rotationally by a drive mechanism (not shown). When the paper sheet 2 is not fed, the feed roller 4 is separated from the paper sheet 2. The feed roller 5 further feeds the paper sheet 2 which is fed by the feed roller 4 to the paper sheet outlet 82 of the housing 8 through below the printing head 7. The printing head 7 prints an image on the paper sheet 2 fed by the feed roller 5. The paper sheet 2 on which the image is printed by the printing head 7 is emitted from the paper sheet outlet 82.

Subsequently, the above-mentioned paper rest will be described in detail. As described above, the paper rest 3 has the fixed rest portion 31 and the movable rest portion 32. The fixed rest portion 31 is formed integrally with the housing 8. A plane 31*a* of the fixed rest portion 31 on which the paper sheet 2 is placed is obliquely inclined in the direction of feeding of the paper sheet 2 with respect to a horizontal plane. The movable rest portion 32 is rotatably supported around an axis part 33 on the fixed rest portion 31. Inclination of a plane 32*a* of the movable rest portion 32 on which the paper sheet 2 is placed varies with rotation of the movable rest portion 32. A rotation center axis C is horizontal and perpendicular to the direction of feeding of the paper sheet 2. A torsion spring 40 is interposed between the fixed rest portion 31 and the movable rest portion 32, so that position of the movable rest portion 32 is maintained due to elastic force of the torsion spring 40.

A center coil portion of the torsion spring 40 is fitted to a shaft 32*b* of the movable rest portion 32. An arm of the torsion spring 40 is engaged with a boss 31*b* of the fixed rest portion 31 and the other arm of the torsion spring 40 is engaged with a rear face of the movable rest portion 32. That is, the torsion spring 40 is attached so as to generate elastic force according to movement of the movable rest portion 32 in a backward direction shown by arrow A in FIG. 1.

When no paper sheet 2 is placed on the paper rest 3, the movable rest portion 32 is held due to elastic force of the torsion spring 40 as an initial position so that an angle that the paper sheet placement plane 32*a* of the movable rest portion 32 forms with the paper sheet placement plane 31*a* of the fixed rest portion 31 becomes an initial angle less than 180 degrees. The movable rest portion 32 can be rotated backward against elastic force of the torsion spring 40 from the initial position. That is, the movable rest portion 32 moves so that the angle that the paper sheet placement plane 32*a* forms with the paper sheet placement plane 31*a* becomes larger than the initial angle. Since the movement or rotation of the movable rest portion 32 is restricted by contacting a lower end 32*c* of the movable rest portion 32 with an upper end 31*c* of the fixed rest portion 31, the movable rest portion 32 can be rotated until the paper sheet placement plane 32*a* is substantially in a line with the paper sheet placement plane 31*a*.

FIGS. 3A to 3D show a motion of the paper rest 3. When a bundle of paper sheets 2 is placed on the paper rest 3, the movable rest portion 32 of the paper rest 3 rotates backward due to self-weight of the paper sheets 2 and the position of the movable rest portion 32 is held in a state where self-weight of the paper sheet 2 and elastic force of the torsion spring 40 are in balance. In other words, the position of the movable rest portion 32 of the paper rest 3 varies according to the weight of the bundle of the paper sheets 2 placed thereon, and accordingly, inclination of the paper sheet placement plane 32*a* of the movable rest portion 32 varies. The weight of the bundle of the paper sheets 2 is generally in proportion to the number of the paper sheets 2 or a thickness of each paper sheet 2 forming the bundle.

Figure 3A:
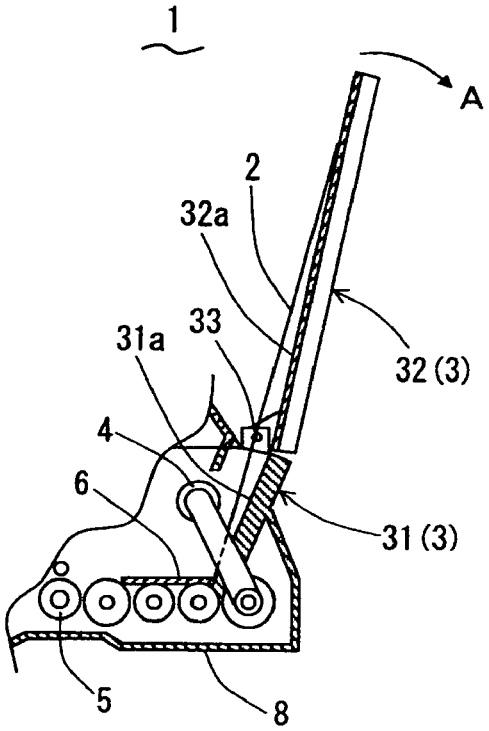
FIGS. 3A and 3B are sectional views showing an operation of a paper rest of the printer when a number of paper sheets placed on a paper rest is smaller.
Figure 3B:
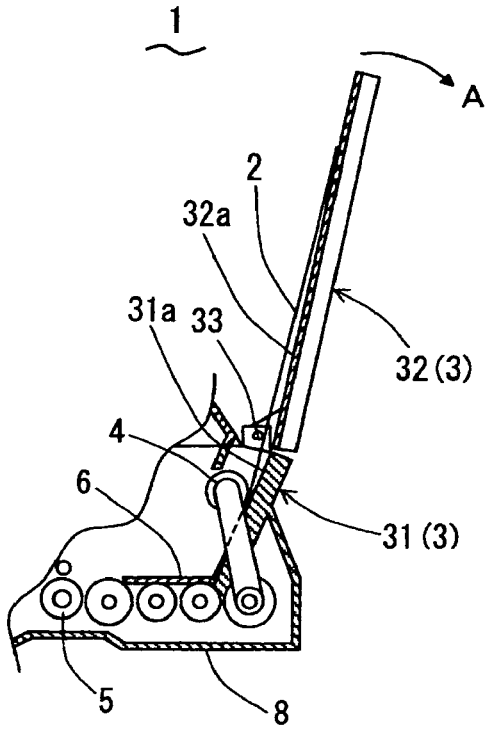

When the number of the paper sheets 2 placed on the paper rest 3 is small, the self-weight of the bundle of the paper sheets 2 is small. Thus, the movable rest portion 32 is rarely rotated from the initial position in the state where no paper sheet 2 is placed on the paper rest 3. The angle that the paper sheet placement plane 31*a* of the fixed rest portion 31 forms with the paper sheet placement plane 32*a* of the movable rest portion 32 becomes less than 180 degrees, as shown in FIG. 3A. When the paper sheet 2 is fed to the feed roller 5, the feed roller 4 is contacted to the paper sheet 2 with a pressure as shown in FIG. 3B, and the paper sheets 2 are divided one by one due to rotation of the feed roller 4 and frictional force of the division pad 6, so that it is fed to the feed roller 5.

When the number of the paper sheets 2 placed on the paper rest 3 is large, the self-weight of the bundle of the paper sheets 2 is large. Thus, the movable rest portion 32 is rotated larger than when the number of the paper sheets 2 is small. The angle that the paper sheet placement plane 32*a* of the movable rest portion 32 forms with the paper sheet placement plane 31*a* of the fixed rest portion 31 becomes larger than that when the number of the paper sheets 2 is small. That is, the paper sheet placement plane 32*a* of the movable rest portion 32 is more horizontally oriented than when the number of the paper sheets 2 is small.

Figure 3C:
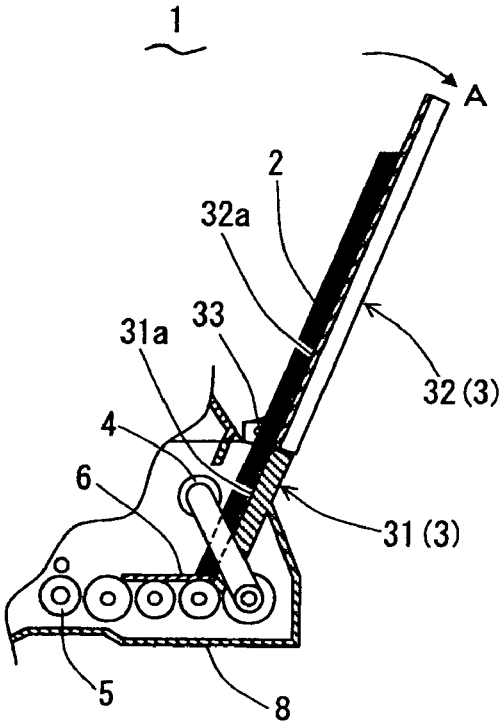
FIGS. 3C and 3D are sectional views showing the operation of the paper rest of the printer when the number of the paper sheets placed on the paper rest is larger.
Figure 3D:
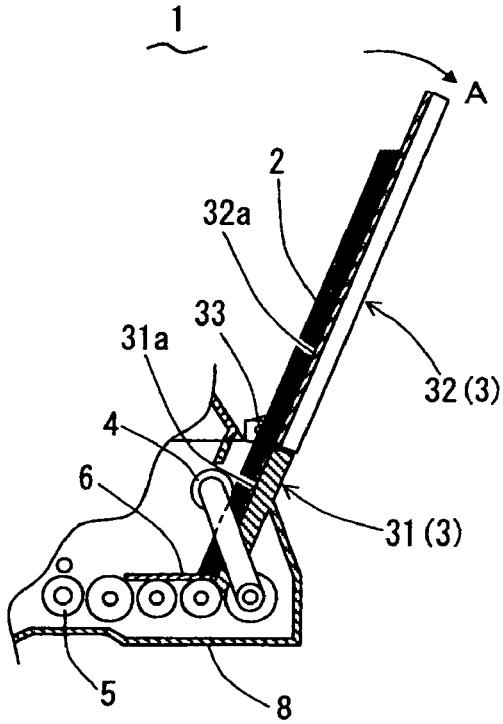

As the number of the paper sheets 2 placed on the paper rest 3 increases, the movable rest portion 32 is rotated at a larger angle. When the number of the paper sheets 2 exceeds a certain value, the movable rest portion 32 is restricted to rotate by contact between the lower end 32*c* of the movable rest portion 32 and the upper end 31*c* of the fixed rest portion 31. The angle that the paper sheet placement plane 32*a* of the movable rest portion 32 forms with the paper sheet placement plane 31*a* of the fixed rest portion 31 becomes close to or substantially 180 degrees, as shown in FIG. 3C. At this time, the paper sheet placement plane 32*a* of the movable rest portion 32 is inclined the most gentle. The paper sheets 2 are divided one by one due to rotation of the feed roller 4 and frictional force of the division pad 6, so that it is fed to the feed roller 5.

In the printer 1 with such configuration, the paper sheet placement plane 32*a* of the movable rest portion 32 is inclined more gentle, when the number of the paper sheets 2 placed on the paper rest 3 is larger. Thus, even when the number of the paper sheets 2 placed on the paper rest 3 is large, failure of feeding of the paper sheet due to increase of the load for feeding the paper sheet 2 caused by, for example, the elasticity of the paper sheet 2 rarely occurs. On the contrary, the paper sheet placement plane 32*a* of the movable rest portion 32 is inclined more steep, when the number of the paper sheets 2 placed on the paper rest 3 is smaller. Thus, even when the number of the paper sheets 2 placed on the paper rest 3 is small, failure of feeding of the paper sheer 2 such as multi-feeding of the paper sheets 2 rarely occurs.

Especially, when the number of the paper sheets 2 placed on the paper rest 3 is small, the angle that the paper sheet placement plane 32*a* of the movable rest portion 32 forms with the paper sheet placement plane 31*a* of the fixed rest portion 31 becomes less than 180 degrees, and as the number of the paper sheets 2 placed on the paper rest 3 increases, the angle that the paper sheet placement plane 32*a* forms with the paper sheet placement plane 31*a* becomes close to 180 degrees, so that failure of feeding of the paper sheet 2 can be prevented more reliably with no relation to the number of the paper sheets 2 placed on the paper rest 3.

The present invention is not limited to the above-mentioned configuration in this embodiment and various modifications are possible. For example, in this embodiment, the movable rest portion 32 may be rotated due to self-weight of the bundle of the paper sheets 2 placed on the paper rest 3 so that the angle that the paper sheet placement plane 32*a* of the movable rest portion 32 forms with the paper sheet placement plane 31*a* of the fixed rest portion 31 exceeds 180 degrees. Attachment configuration of the torsion spring 40 is not limited to the above-mentioned configuration in this embodiment, and any attachment configuration is available so long as it generates elastic force according to rotation of the movable rest portion 32 backward. Furthermore, a plate spring, a compression spring and other elastic members in place of the torsion spring 40 may be employed.

This application is based on Japanese patent application 2004-197270 filed Jul. 2, 2004 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A printer comprising: a paper rest having a paper sheet placement plane on which at one or more paper sheet is placed; a paper sheet feeding mechanism for feeding a paper sheet placed on the paper rest; and a printing head for printing an image on the paper sheet fed by the paper sheet feeding mechanism, wherein the paper rest further has:

a fixed rest portion that is located at a downstream side in a direction of feeding of the paper sheet and fixed so that a paper sheet replacement plane thereof, on which a portion of the paper sheet is placed, is obliquely inclined in a direction of feeding of the paper sheet with respect to a horizontal plane;

a movable rest portion that is located at upstream side in the direction of feeding of the paper sheet and rotatably supported on the fixed rest portion so that inclination of a paper sheet replacement plane thereof can be varied, on which remaining portion of the paper sheet is placed; and an elastic member interposed between the fixed rest portion and the movable rest portion for generating elastic force according to rotation of the movable rest portion; and wherein when no paper sheet is placed on the paper rest, the movable rest portion is held at an initial position where an angle that the paper sheet placement plane of the movable rest portion forms with the paper sheet placement plane of the fixed portion is less than 180 degrees due to elastic force of the elastic member; and the movable rest portion is rotatable backward against the elastic force of the elastic member from the initial position by self-weight of the paper sheet or paper sheets placed on the paper rest.

2. The printer in accordance with claim 1, wherein rotation of the movable rest portion backward is restricted when a lower end of the movable rest portion contacts with an upper end of the fixed rest portion, and the angle that the paper sheet placement plane of the movable rest portion forms with the paper sheet placement plane of the fixed portion becomes substantially 180 degrees.

3. A printer comprising: a paper rest having a paper sheet placement plane on which at one or more paper sheet is placed; a paper sheet feeding mechanism for feeding a paper sheet placed on the paper rest; and a printing head for printing an image on the paper sheet fed by the paper sheet feeding mechanism, wherein the paper rest further has:

a fixed rest portion that is located at a downstream side in a direction of feeding of the paper sheet and fixed so that a paper sheet replacement plane thereof, on which a portion of the paper sheet is placed, is obliquely inclined in a direction of feeding of the paper sheet with respect to a horizontal plane;

a movable rest portion that is located at upstream side in the direction of feeding of the paper sheet and rotatably supported on the fixed rest portion so that inclination of a paper sheet replacement plane thereof can be varied, on which remaining portion of the paper sheet is placed; and a torsion spring interposed between the fixed rest portion and the movable rest portion for generating elastic force according to rotation of the movable rest portion; and wherein when no paper sheet is placed on the paper rest, the movable rest portion is held at an initial position where an angle that the paper sheet placement plane of the movable rest portion forms with the paper sheet placement plane of the fixed portion is less than 180 degrees due to elastic force of the torsion spring; and when at least a paper sheet is placed on the paper rest, the movable rest portion is rotated by self-weight of the paper sheet against the elastic force of the torsion spring from the initial position for increasing the angle that the paper sheet placement plane of the movable rest portion forms with the paper sheet placement plane of the fixed portion until substantially 180 degrees, so that the inclination of the movable rest portion becomes more gentle as a number of paper sheets placed on the paper rest is larger.

4. The printer in accordance with claim 1, wherein the fixed rest portion is formed integrally with a housing that includes the paper sheet feeding mechanism and the printing head.

5. The printer in accordance with claim 3, wherein a center coil portion of the torsion spring is fitted to a shaft of the movable rest portion, a first arm of the torsion spring is engaged with the fixed rest portion and a second arm of the torsion spring is engaged with the movable rest portion.

* * * * *